US008778099B2

(12) United States Patent
Pandey

(10) Patent No.: US 8,778,099 B2
(45) **Date of Patent: *Jul. 15, 2014**

(54) CONVERSION PROCESS FOR HEAT TREATABLE $L1_2$ ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 497 days.

This patent is subject to a terminal disclaimer.

(21) Appl. No.: 12/316,020

(22) Filed: Dec. 9, 2008

(65) Prior Publication Data

US 2010/0139815 A1 Jun. 10, 2010

(51) Int. Cl.
*C22F 1/04* (2006.01)

(52) U.S. Cl.
USPC ..... 148/549; 148/688

(58) Field of Classification Search
USPC ..... 148/688, 698–702, 437–440, 549–552; 419/1, 26, 48, 29–31, 38–43, 66–69; 420/529, 531–535, 537, 538, 540–553
See application file for complete search history.

(56) References Cited

U.S. PATENT DOCUMENTS

| | | | |
|---|---|---|---|
| 3,619,181 | A | 11/1971 | Willey et al. |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | La Caer et al. |
| 4,713,216 | A | 12/1987 | Higashi et al. |
| 4,755,221 | A | 7/1988 | Paliwal et al. |
| 4,832,741 | A | 5/1989 | Couper |
| 4,834,810 | A | 5/1989 | Benn et al. |
| 4,834,942 | A | 5/1989 | Frazier et al. |
| 4,853,178 | A | 8/1989 | Oslin |
| 4,865,806 | A | 9/1989 | Skibo et al. |
| 4,874,440 | A | 10/1989 | Sawtell et al. |

(Continued)

FOREIGN PATENT DOCUMENTS

| | | | |
|---|---|---|---|
| CN | 1436870 | A | 8/2003 |
| CN | 101205578 | A | 6/2008 |

(Continued)

OTHER PUBLICATIONS

Unal et al. "Gas Atomization" from the section "Production of Aluminum and Aluminum-Alloy Powder." ASM Handbook, vol. 7. 2002.*

(Continued)

*Primary Examiner* — Brian Walck
(74) *Attorney, Agent, or Firm* — Kinney & Lange, P.A.

(57) ABSTRACT

A method for producing high strength aluminum alloy containing $L1_2$ intermetallic dispersoids by using gas atomization to produce powder that is then consolidated into $L1_2$ aluminum alloy billets or by casting the alloy into molds to produce $L1_2$ aluminum alloy billets or by casting the alloy into directly useable parts.

11 Claims, 11 Drawing Sheets

(56) References Cited

U.S. PATENT DOCUMENTS

| | | | |
|---|---|---|---|
| 4,915,605 | A | 4/1990 | Chan et al. |
| 4,923,532 | A | 5/1990 | Zedalis et al. |
| 4,927,470 | A | 5/1990 | Cho |
| 4,933,140 | A | 6/1990 | Oslin |
| 4,946,517 | A | 8/1990 | Cho |
| 4,964,927 | A | 10/1990 | Shiflet et al. |
| 4,988,464 | A | 1/1991 | Riley |
| 5,032,352 | A | 7/1991 | Meeks et al. |
| 5,053,084 | A | 10/1991 | Masumoto et al. |
| 5,055,257 | A | 10/1991 | Chakrabarti et al. |
| 5,059,390 | A | 10/1991 | Burleigh et al. |
| 5,066,342 | A | 11/1991 | Rioja et al. |
| 5,076,340 | A | 12/1991 | Bruski et al. |
| 5,133,931 | A | 7/1992 | Cho |
| 5,198,045 | A | 3/1993 | Cho et al. |
| 5,211,910 | A | 5/1993 | Pickens et al. |
| 5,226,983 | A | 7/1993 | Skinner et al. |
| 5,256,215 | A | 10/1993 | Horimura |
| 5,308,410 | A | 5/1994 | Horimura et al. |
| 5,312,494 | A | 5/1994 | Horimura et al. |
| 5,318,641 | A | 6/1994 | Masumoto et al. |
| 5,397,403 | A | 3/1995 | Horimura et al. |
| 5,458,700 | A | 10/1995 | Masumoto et al. |
| 5,462,712 | A | 10/1995 | Langan et al. |
| 5,480,470 | A | 1/1996 | Miller et al. |
| 5,532,069 | A | 7/1996 | Masumoto et al. |
| 5,597,529 | A | 1/1997 | Tack |
| 5,620,652 | A | 4/1997 | Tack et al. |
| 5,624,632 | A | 4/1997 | Baumann et al. |
| 5,882,449 | A | 3/1999 | Waldron et al. |
| 6,139,653 | A | 10/2000 | Fernandes et al. |
| 6,149,737 | A | 11/2000 | Hattori et al. |
| 6,248,453 | B1 | 6/2001 | Watson |
| 6,254,704 | B1 | 7/2001 | Laul et al. |
| 6,258,318 | B1 | 7/2001 | Lenczowski et al. |
| 6,309,594 | B1 | 10/2001 | Meeks, III et al. |
| 6,312,643 | B1 | 11/2001 | Upadhya et al. |
| 6,315,948 | B1 | 11/2001 | Lenczowski et al. |
| 6,331,218 | B1 | 12/2001 | Inoue et al. |
| 6,355,209 | B1 | 3/2002 | Dilmore et al. |
| 6,368,427 | B1 | 4/2002 | Sigworth |
| 6,506,503 | B1 | 1/2003 | Mergen et al. |
| 6,517,954 | B1 | 2/2003 | Mergen et al. |
| 6,524,410 | B1 | 2/2003 | Kramer et al. |
| 6,531,004 | B1 | 3/2003 | Lenczowski et al. |
| 6,562,154 | B1 | 5/2003 | Rioja et al. |
| 6,630,008 | B1 | 10/2003 | Meeks, III et al. |
| 6,702,982 | B1 | 3/2004 | Chin et al. |
| 6,902,699 | B2 | 6/2005 | Fritzemeier et al. |
| 6,918,970 | B2 | 7/2005 | Lee et al. |
| 6,974,510 | B2 | 12/2005 | Watson |
| 7,048,815 | B2 | 5/2006 | Senkov et al. |
| 7,097,807 | B1 | 8/2006 | Meeks, III et al. |
| 7,241,328 | B2 | 7/2007 | Keener |
| 7,344,675 | B2 | 3/2008 | Van Daam et al. |
| 2001/0054247 | A1 | 12/2001 | Stall et al. |
| 2003/0192627 | A1 | 10/2003 | Lee et al. |
| 2004/0046402 | A1 | 3/2004 | Winardi |
| 2004/0055671 | A1 | 3/2004 | Olson et al. |
| 2004/0089382 | A1 | 5/2004 | Senkov et al. |
| 2004/0170522 | A1 | 9/2004 | Watson |
| 2004/0191111 | A1 | 9/2004 | Nie et al. |
| 2005/0013725 | A1 | 1/2005 | Hsiao |
| 2005/0147520 | A1 | 7/2005 | Canzona |
| 2006/0011272 | A1 | 1/2006 | Lin et al. |
| 2006/0093512 | A1 | 5/2006 | Pandey |
| 2006/0172073 | A1 | 8/2006 | Groza et al. |
| 2006/0269437 | A1 | 11/2006 | Pandey |
| 2007/0048167 | A1 | 3/2007 | Yano |
| 2007/0062669 | A1 | 3/2007 | Song et al. |
| 2008/0066833 | A1 | 3/2008 | Lin et al. |
| 2008/0138239 | A1 * | 6/2008 | Olson et al. ..... 420/531 |

FOREIGN PATENT DOCUMENTS

| | | | |
|---|---|---|---|
| EP | 0 208 631 | A1 | 6/1986 |
| EP | 0 584 596 | A2 | 3/1994 |
| EP | 1 111 079 | A1 | 6/2001 |
| EP | 1 249 303 | A1 | 10/2002 |
| EP | 1 170 394 | B1 | 4/2004 |
| EP | 1 439 239 | A1 | 7/2004 |
| EP | 1 471 157 | A1 | 10/2004 |
| EP | 1 111 078 | B1 | 9/2006 |
| EP | 1 728 881 | A2 | 12/2006 |
| EP | 1 788 102 | A1 | 5/2007 |
| EP | 2110452 | A1 | 10/2009 |
| FR | 2 656 629 | A1 | 12/1990 |
| FR | 2843754 | A1 | 2/2004 |
| JP | 04218638 | A | 8/1992 |
| JP | 9104940 | A | 4/1997 |
| JP | 11156584 | A | 6/1999 |
| JP | 2000119786 | A | 4/2000 |
| JP | 2001038442 | A | 2/2001 |
| JP | 2006248372 | A | 9/2006 |
| JP | 2007188878 | A | 7/2007 |
| KR | 20040067608 | A | 7/2004 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | 9111540 | A1 | 8/1991 |
| WO | 9532074 | A2 | 11/1995 |
| WO | WO 96/10099 | A1 | 4/1996 |
| WO | 9279284 | A | 10/1997 |
| WO | 9833947 | A1 | 8/1998 |
| WO | 00 37696 | A1 | 6/2000 |
| WO | 0112868 | A1 | 2/2001 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 6/2004 |
| WO | 2005 045080 | A1 | 5/2005 |
| WO | 2005047554 | A1 | 5/2005 |

OTHER PUBLICATIONS

Cook, R., et al. "Aluminum and Aluminum Alloy Powders for P/M Applications." The Aluminum Powder Company Limited, Ceracon Inc.

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of Al88RE8Ni4 amorphous alloys." Philosophical Magazine A, 2000, vol. 80, No. 5, pp. 1193-1206.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al—Zn—Mg—Zr—Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of Al3Sc with ternary transition-metal additions." Materials Science and Engineering A329-331 (2002) 686-695.

Riddle, Y.W., et al. "A Study of Coarsening, Recrystallization, and Morphology of Microstructure in Al—Sc—(Zr)—(Mg) Alloys." Metallurgical and Materials Transactions A. vol. 35A, Jan. 2004. pp. 341-350.

(56) References Cited

OTHER PUBLICATIONS

Mil'Man, Y.V. et al. "Effect of Additional Alloying with Transition Metals on the STructure of an Al-7.1 Zn-1.3 Mg-0.12 Zr Alloy." Metallofizika I Noveishie Teknohologii, 26 (10), 1363-1378, 2004.
Tian, N. et al. "Heating rate dependence of glass transition and primary crystallization of Al88Gd6Er2Ni4 metallic glass." Scripta Materialia 53 (2005) pp. 681-685.
Litynska, L. et al. "Experimental and theoretical characterization of A13Sc precipitates in Al—Mg—Si—Cu—Sc—Zr alloys." Zeitschrift Fur Metallkunde. vol. 97, No. 3. Jan. 1, 2006. pp. 321-324.
Rachek, O.P. "X-ray diffraction study of amorphous alloys Al—Ni—Ce—Sc with using Ehrenfest's formula." Journal of Non-Crystalline Solids 352 (2006) pp. 3781-3786.
Pandey A B et al, "High Strength Discontinuously Reinforced Aluminum For Rocket Applications," Affordable Metal Matrix Composites For High Performance Applications. Symposia Proceedings, TMS (The Minerals, Metals & Materials Society), US, No. 2nd, Jan. 1, 2008, pp. 3-12.
Niu, Ben et al. "Influence of addition of 1-15 erbium on microstructure and crystallization behavior of Al—Ni—Y amorphous alloy" Zhongguo Xitu Xuebao, 26(4), pp. 450-454. 2008.
Riddle, Y.W., et al. "Recrystallization Performance of AA7050 Varied with Sc and Zr." Materials Science Forum. 2000. pp. 799-804.
Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.
Hardness Conversion Table. Downloaded from http://www.gordonengland.co.uk/hardness/hardness_conversion_2m.htm.
Cabbibo, M. et al., "A TEM study of the combined effect of severe plastic deformation and (Zr), (Sc+Zr)-containing dispersoids on an Al—Mg—Si alloy" Journal of Materials Science, vol. 41, Nol. 16, Jun. 6, 2006. pp. 5329-5338.
Litynska-Dobrzynska, L. "Effect of heat treatment on the sequence of phases formation in Al—Mg—Si alloy with Sc and Zr additions" Archives of Metallurgy and Materials. 51 (4), pp. 555-560, 2006.
Litynska-Dobrzynska, L. "Precipitation of Phases in Al—Mg—Si—Cu Alloy with Sc and Zr and Zr Additions During Heat Treatment" Diffusion and Defect Data, Solid State Data, Part B, Solid Statephenomena. vol. 130, No. Applied Crystallography, Jan. 1, 2007. pp. 163-166.

* cited by examiner

CONVERSION PROCESS FOR HEAT TREATABLE $L1_2$ ALUMINUM ALLOYS

CROSS-REFERENCE TO RELATED APPLICATION(S)

This application is related to the following co-pending applications that are filed on even date herewith and are assigned to the same assignee: A METHOD FOR FORMING HIGH STRENGTH ALUMINUM ALLOYS CONTAINING $L1_2$ INTERMETALLIC DISPERSOIDS, Ser. No. 12/316,046, and A METHOD FOR PRODUCING HIGH STRENGTH ALUMINUM ALLOY POWDER CONTAINING $L1_2$ INTERMETALLIC DISPERSOIDS, Ser. No. 12/316,047.

This application is also related to the following co-pending applications that were filed on Apr. 18, 2008, and are assigned to the same assignee: L12 ALUMINUM ALLOYS WITH BIMODAL AND TRIMODAL DISTRIBUTION, Ser. No. 12/148,395; DISPERSION STRENGTHENED L12 ALUMINUM ALLOYS, Ser. No. 12/148,432; HEAT TREATABLE L12 ALUMINUM ALLOYS, Ser. No. 12/148,383; HIGH STRENGTH L12 ALUMINUM ALLOYS, Ser. No. 12/148,394; HIGH STRENGTH L12 ALUMINUM ALLOYS, Ser. No. 12/148,382; HEAT TREATABLE L12 ALUMINUM ALLOYS, Ser. No. 12/148,396; HIGH STRENGTH L12 ALUMINUM ALLOYS, Ser. No. 12/148,387; HIGH STRENGTH ALUMINUM ALLOYS WITH L12 PRECIPITATES, Ser. No. 12/148,426; HIGH STRENGTH L12 ALUMINUM ALLOYS, Ser. No. 12/148,459; and L12 STRENGTHENED AMORPHOUS ALUMINUM ALLOYS, Ser. No. 12/148,458.

BACKGROUND

The present invention relates generally to aluminum alloys and more specifically to a method for forming heat treatable high strength aluminum alloy parts having $L1_2$ dispersoids therein.

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 owned by the assignee of the present invention discloses aluminum alloys strengthened by dispersed $Al_3X$ $L1_2$ intermetallic phases where X is selected from the group consisting of Sc, Er, Lu, Yb, Tm, and Lu. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). U.S. Patent Application Publication No. 2006/0269437 A1, also commonly owned discloses a high strength aluminum alloy that contains scandium and other elements that is strengthened by $L1_2$ dispersoids.

$L1_2$ strengthened aluminum alloys have high strength and improved fatigue properties compared to commercially available aluminum alloys. Fine grain size results in improved mechanical properties of materials. Hall-Petch strengthening has been known for decades where strength increases as grain size decreases. An optimum grain size for optimum strength is in the nano range of about 30 to 100 nm. These alloys also have lower ductility.

SUMMARY

The present invention is a method for forming heat treatable aluminum alloy components with high strength and acceptable fracture toughness. In embodiments, components are aluminum alloys having coherent $L1_2$ $Al_3X$ dispersoids where X is at least one first element selected from scandium, erbium, thulium, ytterbium, and lutetium, and at least one second element selected from gadolinium, yttrium, zirconium, titanium, hafnium, and niobium. The balance is substantially aluminum containing at least one alloying element selected from silicon, magnesium, lithium, copper, and zinc.

The heat treatable $L1_2$ aluminum alloy components are formed by powder metallurgy or by casting. Following consolidation, the alloys are deformation processed to refine the microstructure and to form the alloys into useful shapes. The alloys are then solution annealed to dissolve the $L1_2$ forming alloying elements and quenched. Aging then precipitates the $L1_2$ strengthening dispersoids.

DETAILED DESCRIPTION

1. $L1_2$ Alloys

Figure 1:
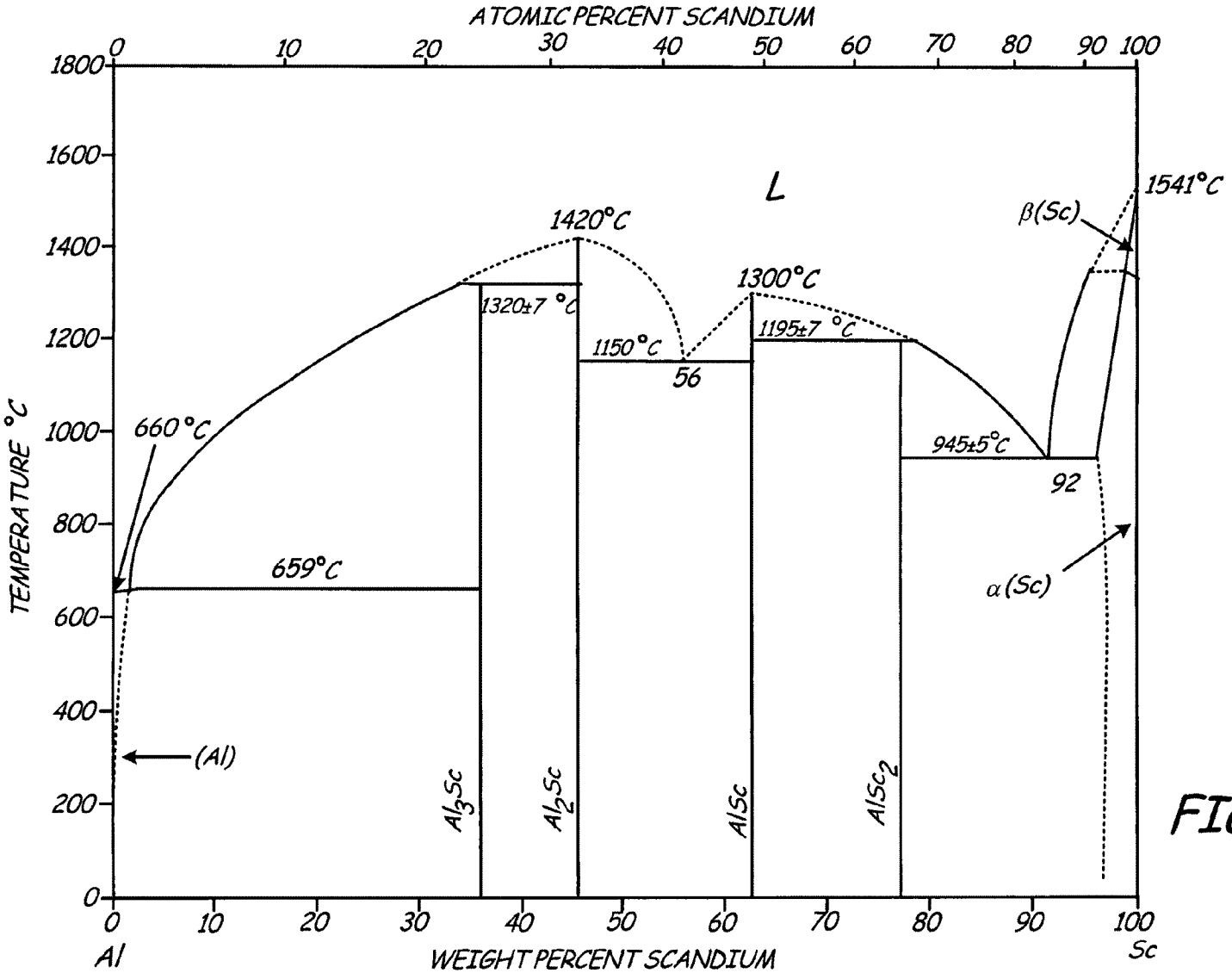
FIG. 1 is an aluminum scandium phase diagram.

Heat treatable alloy powders are formed from aluminum based alloys with high strength and fracture toughness for applications at temperatures from about −420° F. (−251° C.) up to about 650° F. (343° C.). The aluminum alloy comprises a solid solution of aluminum and at least one element selected from silicon, magnesium, lithium, copper, and zinc strengthened by $L1_2$ $Al_3X$ coherent precipitates where X is at least one first element selected from scandium, erbium, thulium, ytterbium, and lutetium, and at least one second element selected from gadolinium, yttrium, zirconium, titanium, hafnium, and niobium.

The alloys of this invention are based on the aluminum magnesium system containing, in addition to the $L1_2$ forming elements listed above, at least one element selected from Si, Li, Cu, Zn and Ni.

The aluminum magnesium phase diagram is a binary system with a eutectic reaction at 36 wt % magnesium and 842° F. (450° C.). Magnesium has maximum solid solubility of 16 wt % in aluminum at about 842° F. (450° C.).

The aluminum silicon phase diagram is a simple eutectic alloy system with a eutectic reaction at 12.5 wt % silicon and 1077° F. (577° C.). There is little solubility of silicon and aluminum at temperatures up to 930° F. (500° C.) and none of aluminum and silicon. Hypoeutectic alloys with less than 12.6 wt % silicon solidify with a microstructure consisting of primary aluminum grains in a finely divided aluminum/silicon eutectic matrix phase.

The aluminum lithium phase diagram is a eutectic alloy system with a eutectic reaction at 8 wt % magnesium and 1104° F. (596° C.). Lithium has maximum solid solubility of about 4.5 wt % in aluminum and 1104° F. (596° C.).

The aluminum copper phase diagram is a eutectic alloy system with a eutectic reaction at 31.2 wt % copper and 1018° F. (548.2° C.). Copper has maximum solid solubility of about 6 wt % in aluminum at 1018° F. (548.2° C.). Copper provides a considerable amount of precipitation strengthening in aluminum by precipitation of fine second phases.

The aluminum zinc phase diagram is a eutectic alloy system involving a monotectoid reaction and a miscibility gap in the solid state. There is a eutectic reaction at 94 wt % zinc at 717.8° F. (381° C.). Zinc has maximum solid solubility of 83.1 wt % in aluminum at 717.8° F. (381° C.). The solubility of zinc in aluminum decreases with a decrease in temperature. Zinc provides significant amounts of precipitation strengthening in aluminum by precipitation of fine second phases.

The aluminum nickel phase diagram is a binary system with a simple eutectic at 5.7 weight percent nickel and 1183.9° F. (639.9° C.). There is little solubility of nickel in aluminum. The equilibrium phase in the aluminum nickel eutectic system is intermetallic $Al_3Ni$.

In the aluminum based alloys disclosed herein, scandium, erbium, thulium, ytterbium, and lutetium are potent strengtheners that have low diffusivity and low solubility in aluminum. All these elements form equilibrium $Al_3X$ intermetallic dispersoids where X is at least one of scandium, erbium, thulium, ytterbium, and lutetium, that have an $L1_2$ structure that is an ordered face centered cubic structure with the X atoms located at the corners and aluminum atoms located on the cube faces of the face centered cubic unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Sc$ to coarsening. Additions of zinc, copper, lithium, and silicon provide solid solution and precipitation strengthening in the aluminum alloys. These $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Er$ to coarsening. Additions of zinc, copper, lithium, and silicon provide solid solution and precipitation strengthening in the aluminum alloys. These $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Tm$ to coarsening. Additions of zinc, copper, lithium, and silicon provide solid solution and precipitation strengthening in the aluminum alloys. These $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Yb$ to coarsening. Additions of zinc, copper, lithium, and silicon provide solid solution and precipitation strengthening in the aluminum alloys. These $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Lu$ to coarsening. Additions of zinc, copper, lithium, and silicon provide solid solution and precipitation strengthening in the aluminum alloys. These $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $DO_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

Heat treatable $L1_2$ phase strengthened aluminum alloys are important structural materials because of their excellent mechanical properties and the stability of these properties at elevated temperature due to the resistance of the coherent dispersoids in the microstructure to particle coarsening. The mechanical properties are optimized by maintaining a high volume fraction of $L1_2$ dispersoids in the microstructure. The $L1_2$ dispersoid concentration following aging scales as the amount of $L1_2$ phase forming elements in solid solution in the aluminum alloy following quenching. Examples of $L1_2$ phase forming elements include but are not limited to Sc, Er, Th, Yb, and Lu. The concentration of alloying elements in solid solution in alloys cooled from the melt is directly proportional to the cooling rate.

Exemplary aluminum alloys of this invention include, but are not limited to (in weight percent unless otherwise specified):

about Al-M-(0.1-0.5)Sc-(0.1-4)Gd;
about Al-M-(0.1-6)Er-(0.1-4)Gd;
about Al-M-(0.1-10)Tm-(0.1-4)Gd;
about Al-M-(0.1-15)Yb-(0.1-4)Gd;
about Al-M-(0.1-12)Lu-(0.1-4)Gd;
about Al-M-(0.1-0.5)Sc-(0.1-4)Y;
about Al-M-(0.1-6)Er-(0.1-4)Y;
about Al-M-(0.1-10)Tm-(0.1-4)Y;
about Al-M-(0.1-15)Yb-(0.1-4)Y;
about Al-M-(0.1-12)Lu-(0.1-4)Y;
about Al-M-(0.1-0.5)Sc-(0.05-1)Zr;
about Al-M-(0.1-6)Er-(0.05-1)Zr;
about Al-M-(0.1-10)Tm-(0.05-1)Zr;
about Al-M-(0.1-15)Yb-(0.05-1)Zr;
about Al-M-(0.1-12)Lu-(0.05-1)Zr;
about Al-M-(0.1-0.5)Sc-(0.05-2)Ti;
about Al-M-(0.1-6)Er-(0.05-2)Ti;
about Al-M-(0.1-10)Tm-(0.05-2)Ti;
about Al-M-(0.1-15)Yb-(0.05-2)Ti;
about Al-M-(0.1-12)Lu-(0.05-2)Ti;
about Al-M-(0.1-0.5)Sc-(0.05-2)Hf;
about Al-M-(0.1-6)Er-(0.05-2)Hf;
about Al-M-(0.1-10)Tm-(0.05-2)Hf;
about Al-M-(0.1-15)Yb-(0.05-2)Hf;
about Al-M-(0.1-12)Lu-(0.05-2)Hf;
about Al-M-(0.1-0.5)Sc-(0.05-1)Nb;
about Al-M-(0.1-6)Er-(0.05-1)Nb;
about Al-M-(0.1-10)Tm-(0.05-1)Nb;
about Al-M-(0.1-15)Yb-(0.05-1)Nb; and
about Al-M-(0.1-12)Lu-(0.05-1)Nb.

M is at least one of about (4-25) weight percent silicon, (0.2-4) weight percent magnesium, (0.5-3) weight percent lithium, (1-8) weight percent copper, (3-12) weight percent zinc and (1-10) weight percent nickel.

The amount of silicon present in the fine grain matrix, if any, may vary from about 4 to about 25 weight percent, more preferably from about 4 to about 18 weight percent, and even more preferably from about 5 to about 11 weight percent.

The amount of magnesium present in the fine grain matrix, if any, may vary from about 0.4 to about 3 weight percent, more preferably from about 0.5 to about 2 weight percent, and even more preferably from about 4 to about 6.5 weight percent.

The amount of lithium present in the fine grain matrix, if any, may vary from about 1 to about 2.5 weight percent, more preferably from about 1 to about 2 weight percent, and even more preferably from about 1 to about 2 weight percent.

The amount of copper present in the fine grain matrix, if any, may vary from about 2 to about 7 weight percent, more preferably from about 3.5 to about 6.5 weight percent, and even more preferably from about 1 to about 2.5 weight percent.

The amount of zinc present in the fine grain matrix, if any, may vary from about 3 to about 12 weight percent, more preferably from about 4 to about 10 weight percent, and even more preferably from about 5 to about 9 weight percent.

The amount of nickel present in the fine grain matrix, if any, may vary from about 1 to about 10 weight percent, more preferably about 2 to about 8 percent, and even more preferably from about 6 to 8 percent.

The amount of scandium present in the fine grain matrix, if any, may vary from 0.1 to about 0.5 weight percent, more preferably from about 0.1 to about 0.35 weight percent, and even more preferably from about 0.1 to about 0.25 weight percent. The Al—Sc phase diagram shown in FIG. 1 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment.

Figure 2:
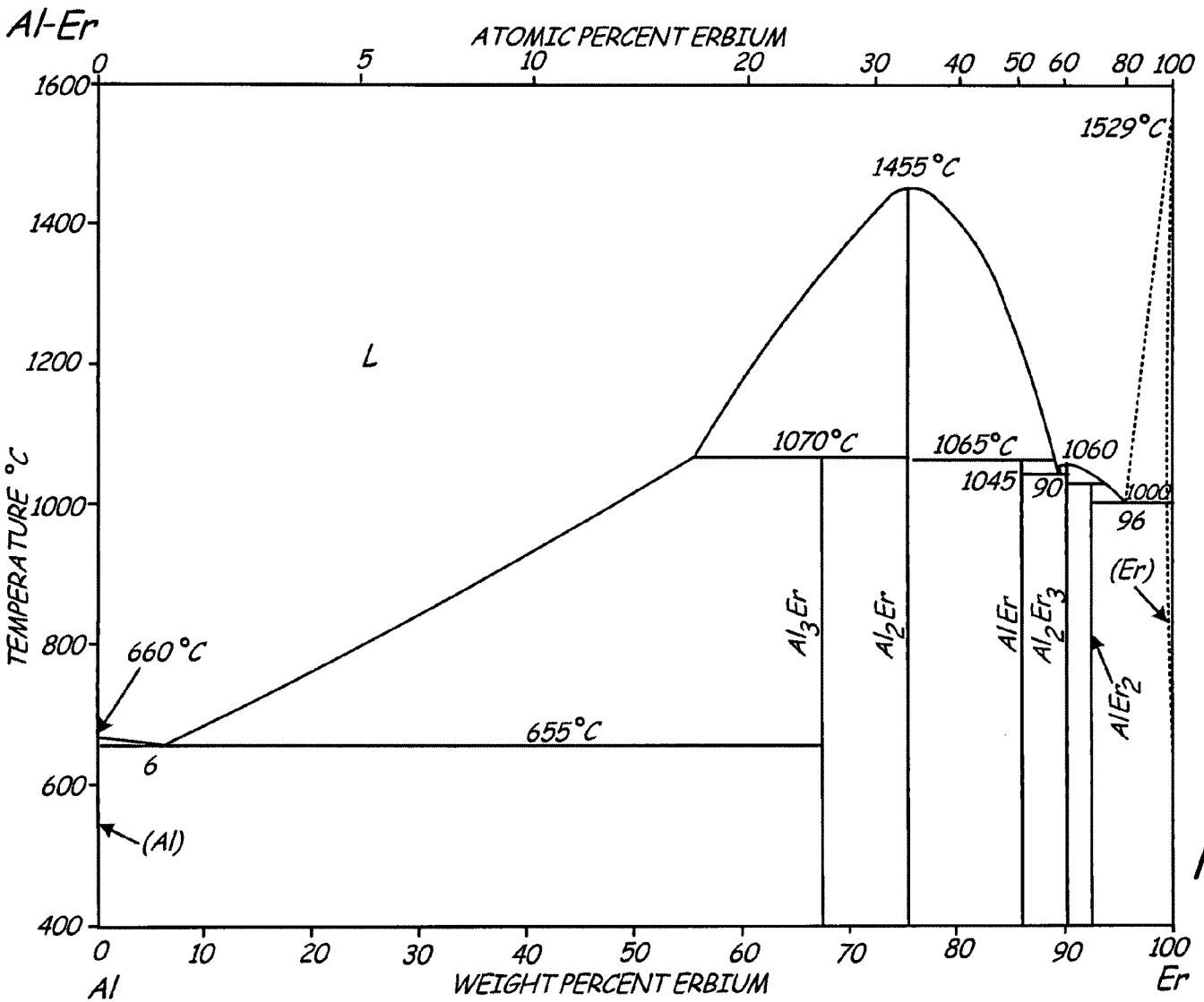
FIG. 2 is an aluminum erbium phase diagram.

The amount of erbium present in the fine grain matrix, if any, may vary from about 0.1 to about 6 weight percent, more preferably from about 0.1 to about 4 weight percent, and even more preferably from about 0.2 to about 2 weight percent. The Al—Er phase diagram shown in FIG. 2 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment.

Figure 3:
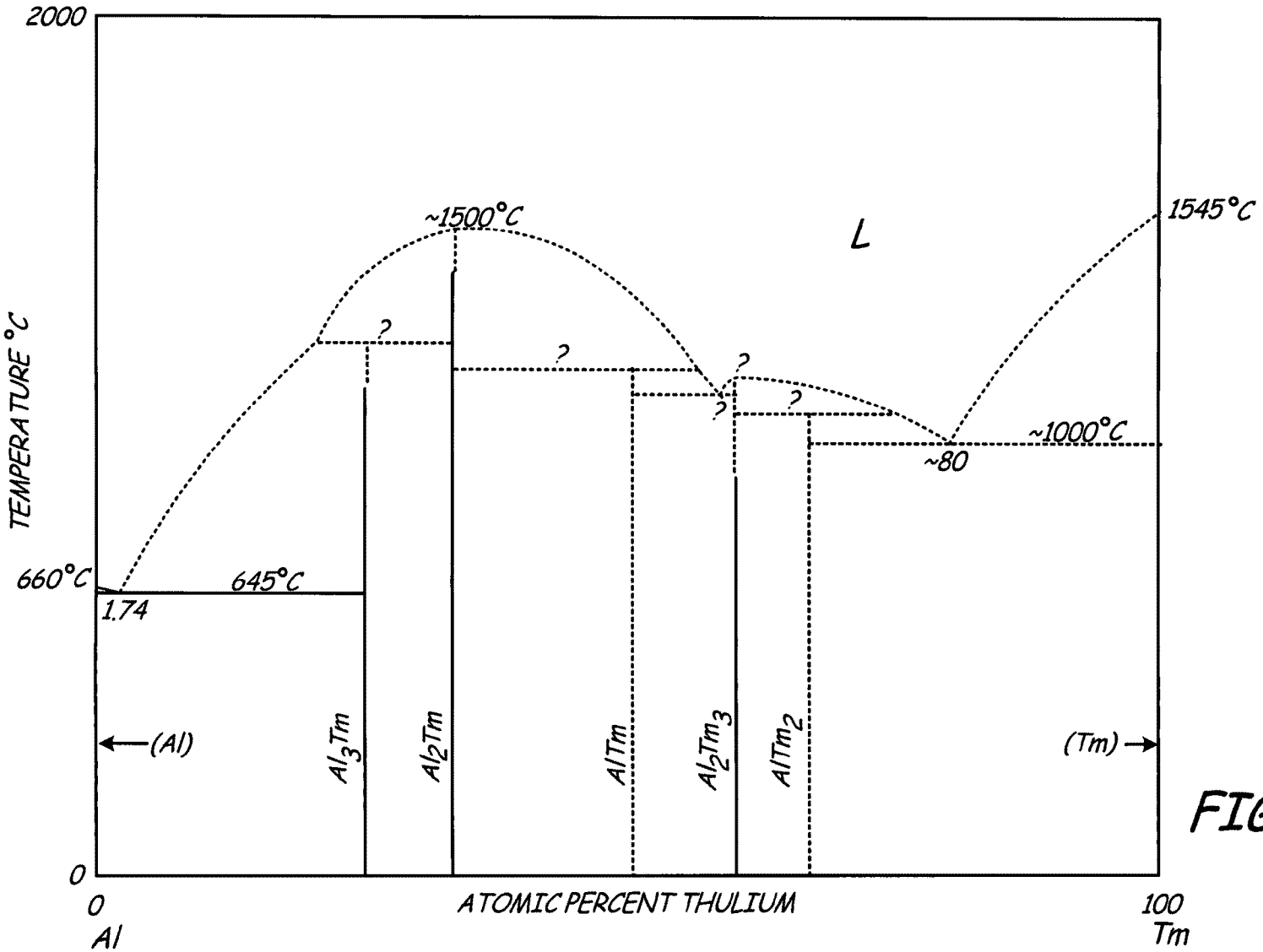
FIG. 3 is an aluminum thulium phase diagram.

The amount of thulium present in the alloys, if any, may vary from about 0.1 to about 10 weight percent, more preferably from about 0.2 to about 6 weight percent, and even more preferably from about 0.2 to about 4 weight percent. The Al—Tm phase diagram shown in FIG. 3 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment.

Figure 4:
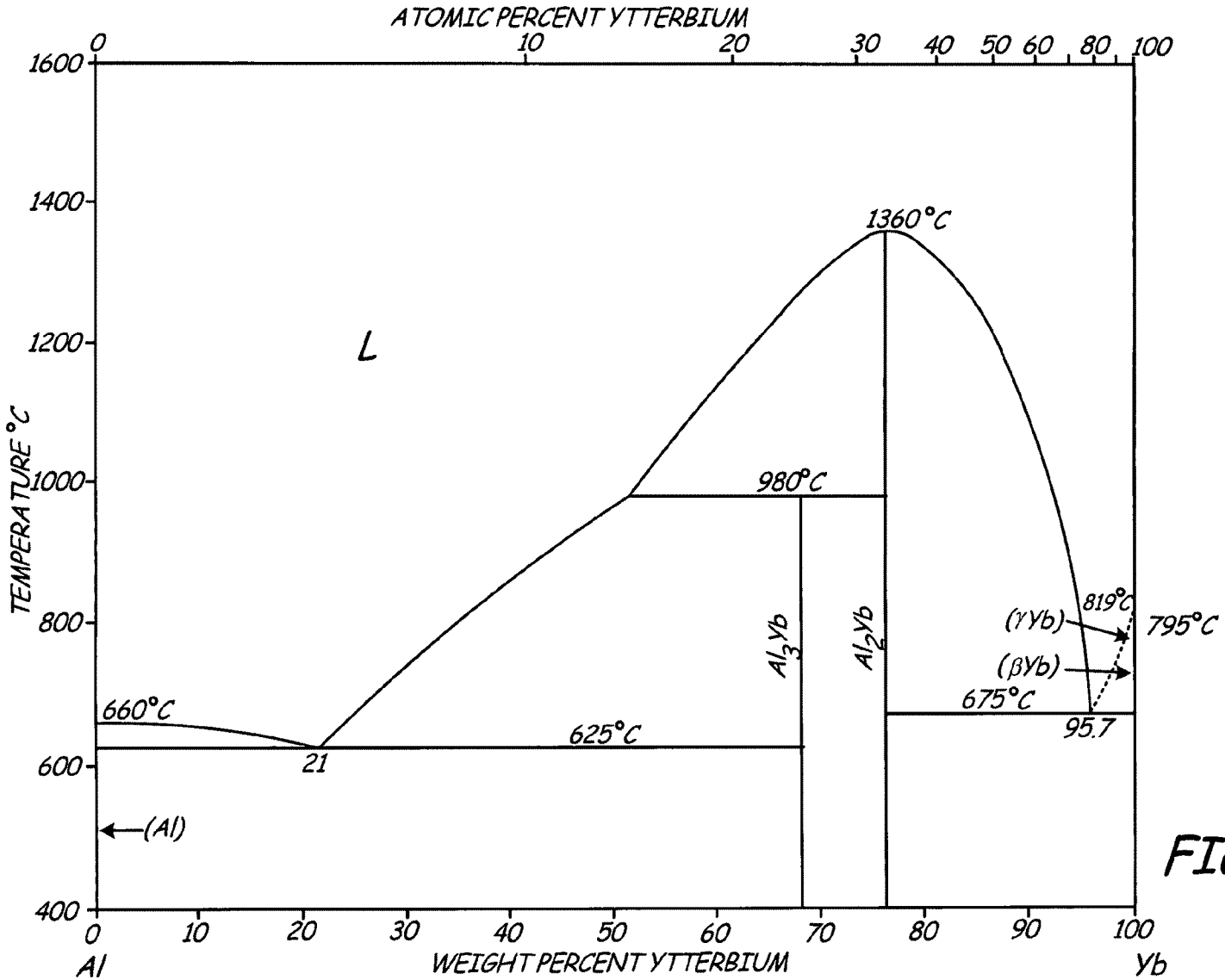
FIG. 4 is an aluminum ytterbium phase diagram.

The amount of ytterbium present in the alloys, if any, may vary from about 0.1 to about 15 weight percent, more preferably from about 0.2 to about 8 weight percent, and even more preferably from about 0.2 to about 4 weight percent. The Al—Yb phase diagram shown in FIG. 4 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment.

Figure 5:
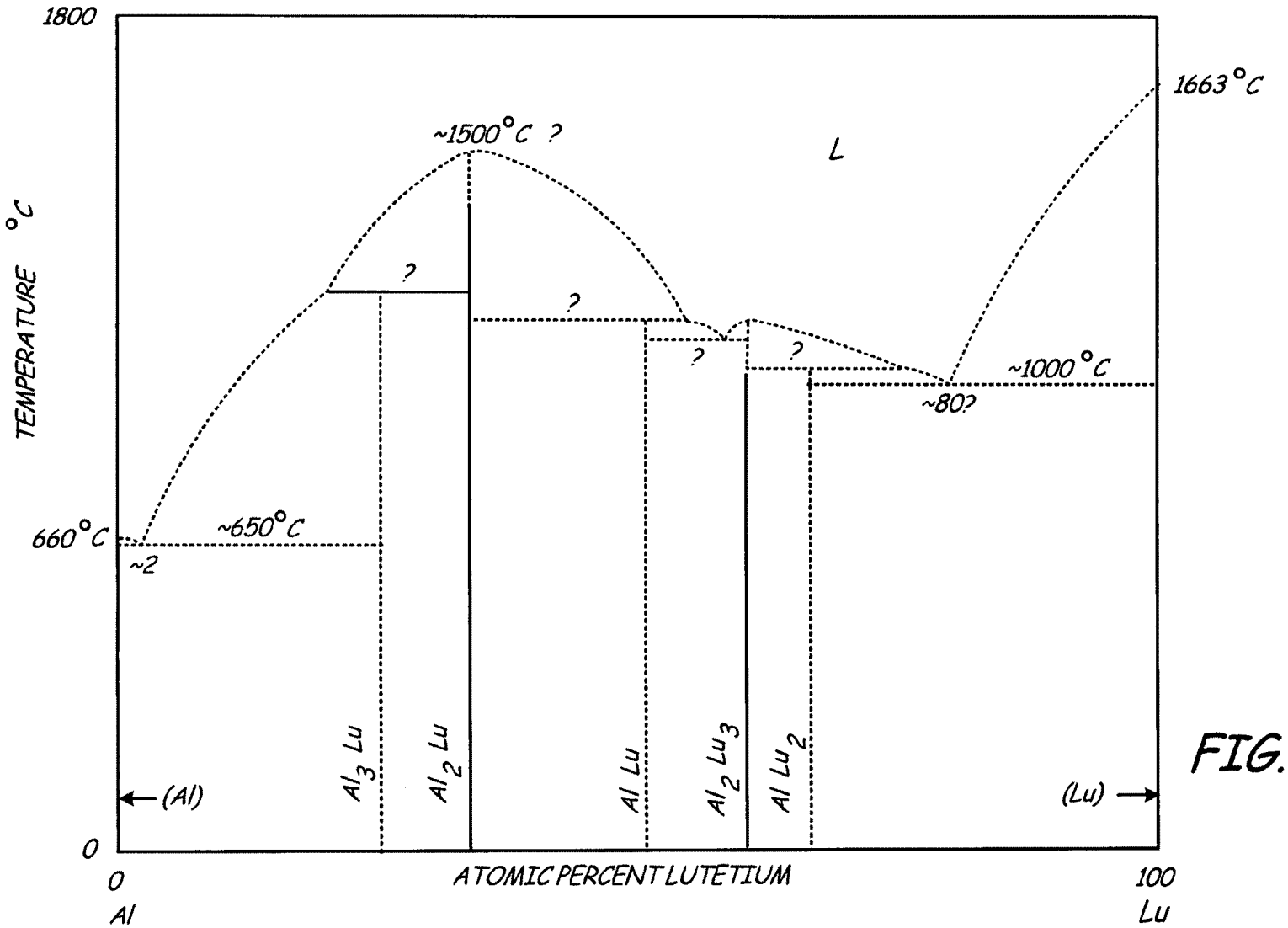
FIG. 5 is an aluminum lutetium phase diagram.

The amount of lutetium present in the alloys, if any, may vary from about 0.1 to about 12 weight percent, more preferably from about 0.2 to about 8 weight percent, and even more preferably from about 0.2 to about 4 weight percent. The Al—Lu phase diagram shown in FIG. 5 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment.

The amount of gadolinium present in the alloys, if any, may vary from about 0.1 to about 4 weight percent, more preferably from about 0.2 to about 2 weight percent, and even more preferably from about 0.5 to about 2 weight percent.

The amount of yttrium present in the alloys, if any, may vary from about 0.1 to about 4 weight percent, more preferably from about 0.2 to about 2 weight percent, and even more preferably from about 0.5 to about 2 weight percent.

The amount of zirconium present in the alloys, if any, may vary from about 0.05 to about 1 weight percent, more preferably from about 0.1 to about 0.75 weight percent, and even more preferably from about 0.1 to about 0.5 weight percent.

The amount of titanium present in the alloys, if any, may vary from about 0.05 to about 2 weight percent, more preferably from about 0.1 to about 1 weight percent, and even more preferably from about 0.1 to about 0.5 weight percent.

The amount of hafnium present in the alloys, if any, may vary from about 0.05 to about 2 weight percent, more preferably from about 0.1 to about 1 weight percent, and even more preferably from about 0.1 to about 0.5 weight percent.

The amount of niobium present in the alloys, if any, may vary from about 0.05 to about 1 weight percent, more preferably from about 0.1 to about 0.75 weight percent, and even more preferably from about 0.1 to about 0.5 weight percent.

In order to have the best properties for the fine grain matrix of this invention, it is desirable to limit the amount of other elements. Specific elements that should be reduced or eliminated include no more than about 0.1 weight percent iron, 0.1 weight percent chromium, 0.1 weight percent manganese, 0.1 weight percent vanadium, and 0.1 weight percent cobalt. The total quantity of additional elements should not exceed about 1% by weight, including the above listed impurities and other elements.

2. Forming Heat Treatable $L1_2$ Alloy Component

Molten $L1_2$ aluminum alloys can be transformed into solid articles by casting or by powder processing. $L1_2$ aluminum alloys can be cast into shapes that are directly utilized or into shapes that are further deformation processed to tailor the microstructure and resulting properties. Aluminum powders are consolidated using powder metallurgy techniques of degassing, pressing and sintering as discussed below.

Gas atomization is a two fluid process wherein a stream of molten metal is disintegrated by a high velocity gas stream. The end result is that the particles of molten metal eventually become spherical due to surface tension and finely solidify in powder form. The solidification rates, depending on the gas and the surrounding environment, can be very high and can exceed $10^{6\circ}$ C./second. Cooling rates greater than $10^{3\circ}$ C./second are typically specified to ensure supersaturation of alloying elements in gas atomized $L1_2$ aluminum alloy powder in the inventive process described herein.

Figure 6A:
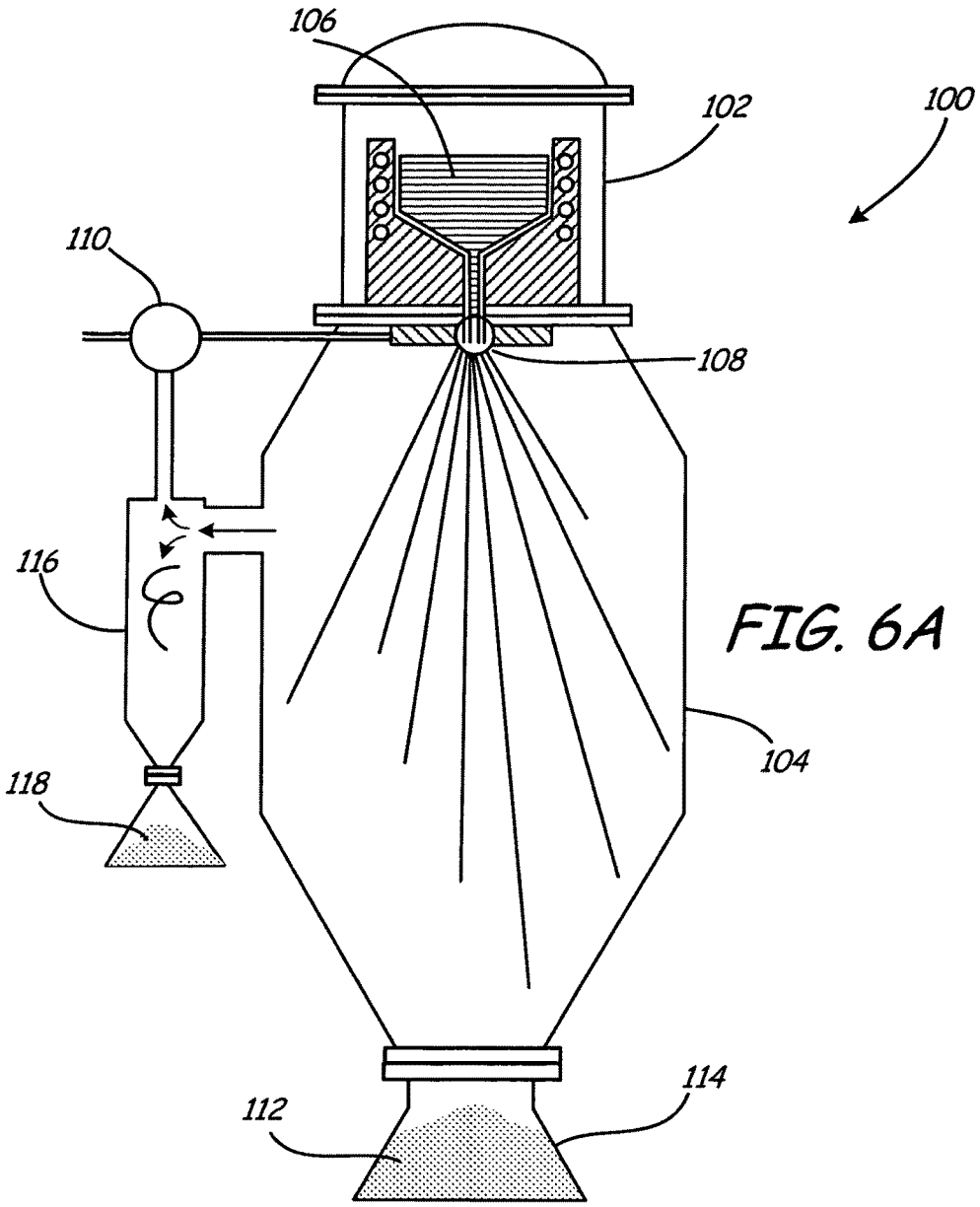
FIG. 6A is a schematic diagram of a vertical gas atomizer.
Figure 6B:
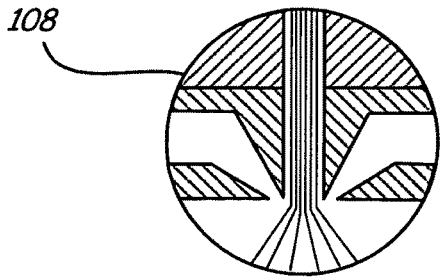
FIG. 6B is a close up view of nozzle 108 in FIG. 6A.

A schematic of typical vertical gas atomizer 100 is shown in FIG. 6A. FIG. 6A is taken from R. Germain, Powder Metallurgy Science Second Edition MPIF (1994) see chapter 3, page 101. Vacuum or inert gas induction melter 102 is positioned at the top of free flight chamber 104. Vacuum induction melter 102 contains melt 106 which flows by gravity or gas overpressure through nozzle 108. A close up view of nozzle 108 is shown in FIG. 6B. Melt 106 enters nozzle 108 and flows downward until it meets high pressure gas stream from gas source 110 where it is transformed into a spray of droplets. The droplets eventually become spherical due to surface tension and rapidly solidify into spherical powder 112 which collects in collection chamber 114. The gas recirculates through cyclone collector 116 which collects fine powder 118 before returning to the input gas stream. As can be seen from FIG. 6A, the surroundings to which the melt and eventual powder are exposed are completely controlled.

To maintain purity, inert gases are used. Helium, argon, and nitrogen are gases used by those in the art. Helium is preferred for rapid solidification because the high heat transfer coefficient of the gas leads to high quenching rates and high supersaturation of alloying elements.

Figure 7A:
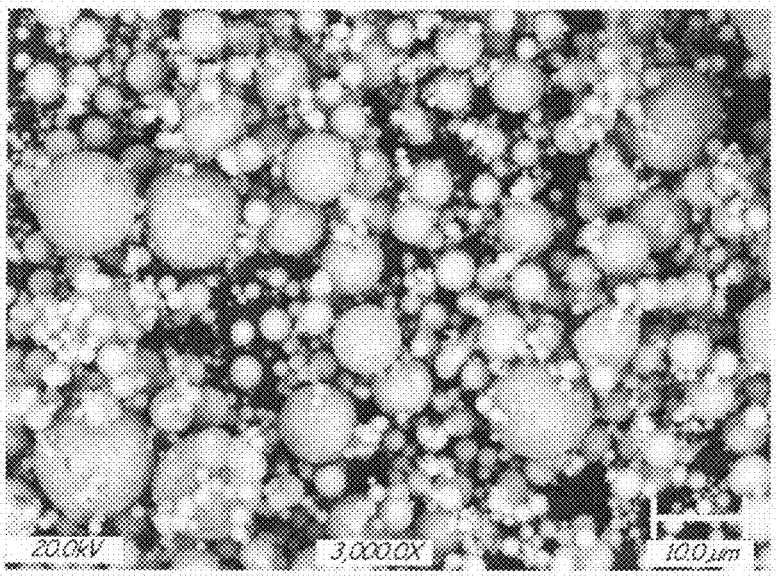
FIGS. 7A and 7B are SEM photos of $L1_2$ aluminum alloy powder.
Figure 7B:
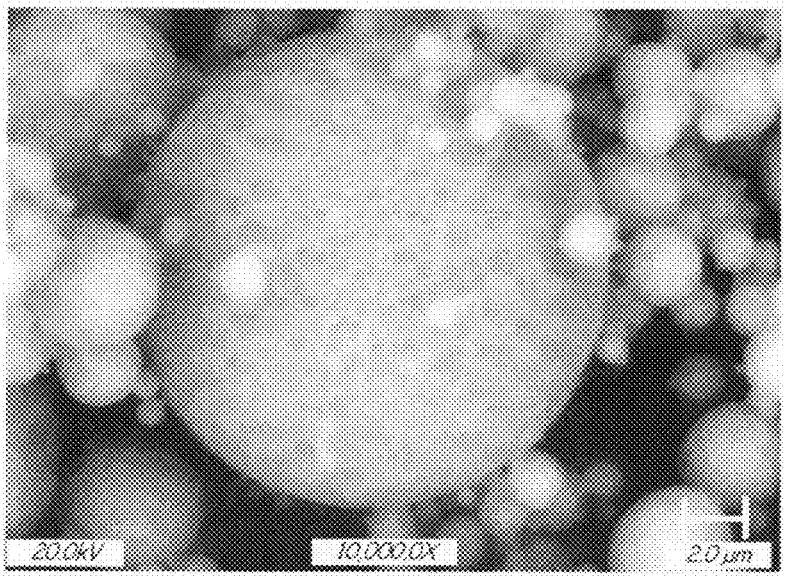
Figure 8A:
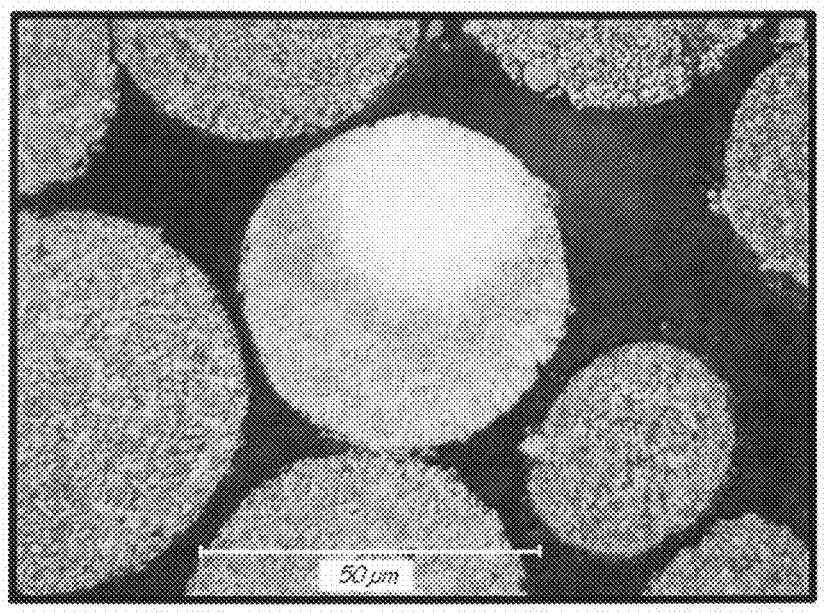
FIGS. 8A and 8B are optical micrographs showing the microstructures of the inventive alloy.
Figure 8B:
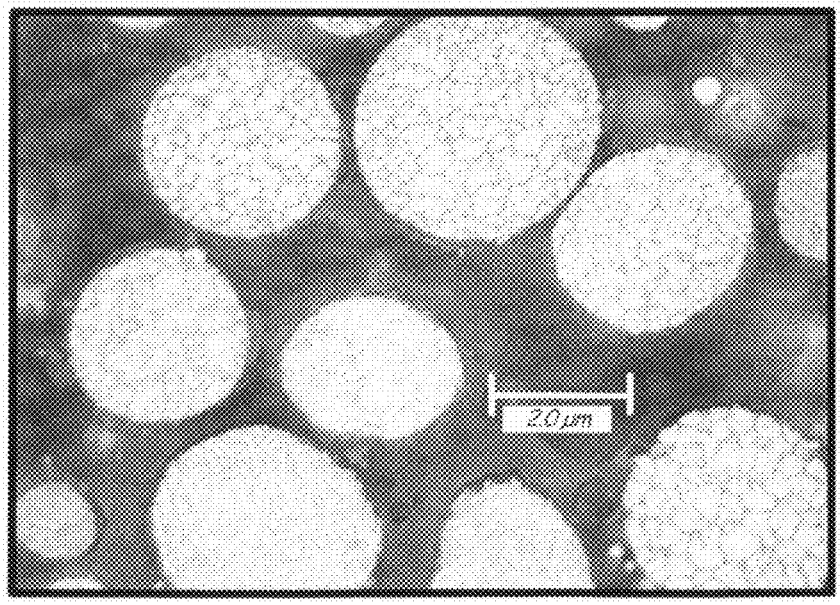

Lower metal flow rates and higher gas flow ratios favor production of finer powders. The particle size of gas atomized melts typically has a log normal distribution. In the turbulent conditions existing at the gas/metal interface during atomization, ultra fine particles can form that may reenter the gas expansion zone. These solidified fine particles can be carried into the flight path of molten larger droplets resulting in agglomeration of small satellite particles on the surfaces of larger particles. An example of small satellite particles attached to inventive spherical $L1_2$ aluminum alloy powder is shown in the scanning electron micrographs (SEM) of FIGS. 7A and 7B at two magnifications. The spherical shape of gas atomized aluminum powder is evident. The satellite particles can be minimized by adjusting processing parameters to reduce or even eliminate turbulence in the gas atomization process. The microstructure of gas atomized aluminum alloy powder is predominantly cellular as shown in the optical micrographs of cross-sections of the inventive alloy in FIGS. 8A and 8B at two magnifications. The rapid cooling rate suppresses dendritic solidification common at slower cooling rates resulting in a finer microstructure with minimum alloy segregation.

Oxygen and hydrogen in the powder can degrade the mechanical properties of the final part. It is preferred to limit the oxygen in the $L1_2$ alloy powder to about 100 ppm to 2000 ppm. Oxygen is intentionally introduced as a component of the helium gas during atomization. An oxide coating on the resulting $L1_2$ aluminum powder is beneficial for two reasons. First, the coating prevents agglomeration by contact sintering and secondly, the coating inhibits the chance of explosion of the powder. A controlled amount of oxygen is important in order to provide good ductility and fracture toughness in the material. Hydrogen content in the powder is controlled by ensuring the dew point of the helium gas is low. A dew point of about −50° F. (−45.5° C.) to −100° F. (−73.3° C.) is preferred.

In preparation for final processing, the powder is classified according to size by sieving. To prepare the powder for sieving, the powder may be exposed to nitrogen gas which passivates the powder surface and prevents agglomeration if the powder has zero percent oxygen. Finer powder sizes result in improved mechanical properties of the end product. While minus 325 mesh (about 45 microns) powder can be used, minus 450 mesh (about 30 microns) powder is the preferred size to provide good mechanical properties in the end. During the atomization process, powder is collected in catch tanks in order to prevent oxidation of the powder. Catch tanks are used at the bottom of the atomization tank as well as at the cyclone to collect the powder. The powder is then transported and stored in the catch tanks. Catch tanks are maintained under positive pressure with nitrogen gas which prevents oxidation of the powder.

Figure 9:
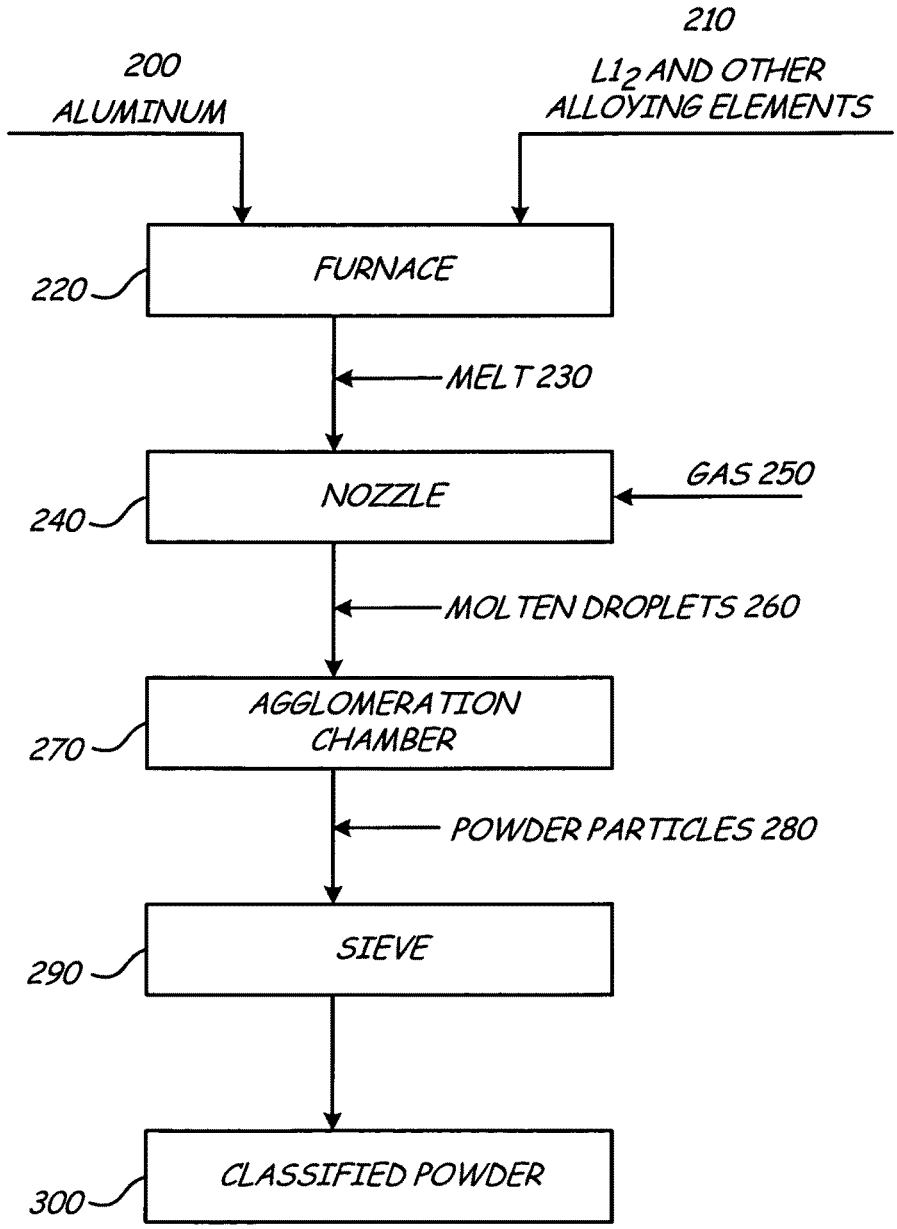
FIG. 9 is a schematic diagram of the gas atomization process.

A schematic of the $L1_2$ aluminum powder manufacturing process is shown in FIG. 9. In the process aluminum 200 and $L1_2$ forming (and other alloying elements) 210 are melted in furnace 220 to a predetermined superheat temperature under vacuum or inert atmosphere. Preferred charge for furnace 220 is prealloyed aluminum 200 and $L1_2$ and other alloying elements before charging furnace 220. Melt 230 is then passed through nozzle 240 where it is impacted by pressurized gas stream 250. Gas stream 250 is an inert gas such as nitrogen, argon or helium, preferably helium. Melt 230 can flow through nozzle 240 under gravity or under pressure. Gravity flow is preferred for the inventive process disclosed herein. Preferred pressures for the pressurized gas stream 250 are about 50 psi (0.35 MPa) to about 750 psi (5.17 MPa) depending on the alloy.

The atomization process creates molten droplets 260 which rapidly solidify as they travel through chamber 270 forming spherical powder particles 280. The molten droplets transfer heat to the atomizing gas by convention. The role of the atomizing gas is two fold: one is to disintegrate the molten metal stream into fine droplets by transferring kinetic energy, the other is to extract heat from the molten droplets to rapidly solidify them into spherical powder. The solidification time and cooling rate of the powder varies with the size of the droplets. Larger sizes of droplets take longer to solidify and the resulting cooling rate is lower. On the other hand, if the size of the droplets is small, the gas will extract heat efficiently which will lessen the time to solidify and will result in a higher cooling rate. Finer powder size is therefore preferred as a higher cooling rate provides finer microstructures and higher mechanical properties in the end product. Higher cooling rates lead to finer cellular microstructures which are preferred for higher mechanical properties. Finer cellular microstructures result in finer grain sizes during consolidation of the powder. Finer grain size provides higher yield strength of the material through the Hall-Petch strengthening model.

Key process variables for gas atomization include melt superheat temperature, nozzle diameter, helium content and dew point of the gas, and metal flow rate and gas to metal flow rate. Nozzle diameters of about 0.07 in. (1.8 mm) to 0.12 in. (3.0 mm) are preferred depending on the alloy. The gas stream used herein was a helium nitrogen mixture containing 74 to 87 vol. % helium. The metal flow rate ranged from about 0.8 lb/min (0.36 kg/min) to 4.0 lb/min (1.81 kg/min). The oxygen content of the $L1_2$ aluminum alloy powders was observed to consistently decrease as a run progressed. This is suggested to be the result of the oxygen gettering capability of the aluminum powder in a closed system. The dew point of the gas was controlled to minimize hydrogen content of the powder. Dew points in the gases used in the examples ranged from −10° F. (−23° C.) to −110° F. (−79° C.).

The powder is then classified by sieving process 290 to create classified powder 300. Sieving of powder is performed under an inert environment to minimize oxygen and hydrogen in the powder from the environment. While the yield of minus mesh powder is extremely high (95%), sieving helps in removing +450 mesh powder and some large flakes and ligaments that can occasionally be present in the powder. Sieving ensures a narrow size distribution of the powder to provide more uniform size of the powder. Sieving also ensures flaw size that cannot be greater than minus 450 mesh which will be required for nondestructive inspection of the final product.

The processing parameters of exemplary gas atomization runs are listed in Table 1.

TABLE 1

Gas atomization parameters used to produce powder

| Run | Nozzle Diameter (in) | He Content (vol %) | Gas Pressure (psi) | Dew Point (° F.) | Charge Temperature (° F.) | Average Metal Flow Rate (lbs/min) | Oxygen Content (ppm) Start | Oxygen Content (ppm) End |
|---|---|---|---|---|---|---|---|---|
| 1 | 0.10 | 79 | 190 | <−58 | 2200 | 2.8 | 340 | 35 |
| 2 | 0.10 | 83 | 192 | −35 | 1635 | 0.8 | 772 | 27 |
| 3 | 0.09 | 78 | 190 | −10 | 2230 | 1.4 | 297 | <0.01 |
| 4 | 0.09 | 85 | 160 | −38 | 1845 | 2.2 | 22 | 4.1 |
| 5 | 0.10 | 86 | 207 | −88 | 1885 | 3.3 | 286 | 208 |
| 6 | 0.09 | 86 | 207 | −92 | 1915 | 2.6 | 145 | 88 |

The role of powder quality is extremely important to produce higher strength and ductility in the end product. Powder quality is determined by the size of the powder, its shape, powder distribution, oxygen and hydrogen content and alloy chemistry. Over fifty atomization runs were performed to produce good quality powder with finer powder size, finer size distribution, spherical shape, lower oxygen and hydrogen contents. Powder was produced with over 95% yield of minus 450 mesh (30 microns) which includes powder from about 1 micron to about 30 microns. The average size of powder was about 10 to 15 microns. Finer powder size is preferred for higher mechanical properties. Finer powders have finer cellular microstructures. Finer cell sizes lead to finer grain size by fragmentation and coalescence of cells during consolidation of the powder. Finer grain sizes produces higher yield strength through the Hall-Petch strengthening model. It is preferred to use an average size of 10-15 microns of powder. Powder smaller than 10-15 microns can be more challenging to handle due to larger surface area. Powder size greater than 10-15 microns results in larger cell sizes which then lead to larger grain sizes and lower yield strengths in the material.

A narrow powder size distribution is preferred. Narrower size distribution results in powders exhibiting the smallest size variation that will, in turn, produce microstructures resulting in a uniform grain size in the final product. Spherical powder shape was produced to provide higher apparent and tap densities which help in achieving 100% density in the consolidated product. Spherical shape is also an indication of cleaner and lower oxygen content powder. Lower oxygen and lower hydrogen content powders produce product with good mechanical properties especially ductility and fracture toughness. However, lower oxygen may cause a challenge with sieving due to powder sintering. Therefore, an oxygen content of about 25 ppm to about 500 ppm is preferred to provide good ductility and fracture toughness without any sieving issues. Lower hydrogen is also preferred for improving ductility and fracture toughness. It is preferred to have 25-200 ppm of hydrogen in atomized powder by controlling the dew point in the atomization chamber. Hydrogen in the powder is further reduced by heating the powder in a vacuum. Lower hydrogen in the final product is preferred to achieve good ductility and fracture toughness.

The properties of five different extruded bars are shown in Table 2. Table 2 shows ultimate tensile strengths over 100 ksi (690 MPa) with good ductility over 6%. Powder produced according the current invention was used for producing the extrusions listed in Table 2. The ultimate tensile strengths and yield strengths of extruded bars of the current invention are significantly (30% to 150%) higher than aluminum alloys which are currently available including 7xxx, 6xxx and 2xxx series alloys. The strength and ductility (measured by elongation and reduction in area) observed in these present extrusions are directly related to the powder quality in terms of powder size, distribution, shape and microstructure.

TABLE 2

Tensile Properties of Extrusions

| Material ID # | Ultimate Tensile Strength, ksi | Yield Strength, ksi | Elongation, % | Reduction in Area, % |
|---|---|---|---|---|
| 1209 | 113.5 (783.5 MPa) | 103.2 (711.5 MPa) | 7 | 15 |
| 1210 | 113.5 (782.5 MPa) | 102 (703.2 MPa) | 6.5 | 12 |
| 1213 | 116.3 (801.9 MPa) | 106.6 (735.0 MPa) | 5.9 | 9 |
| 1216 | 112.6 (776.3 MPa) | 102.3 (705.3 MPa) | 6.5 | 10 |
| 1222 | 116.6 (803.9 MPa) | 106.6 (735.0 MPa) | 6.5 | 14.7 |

Figure 10:
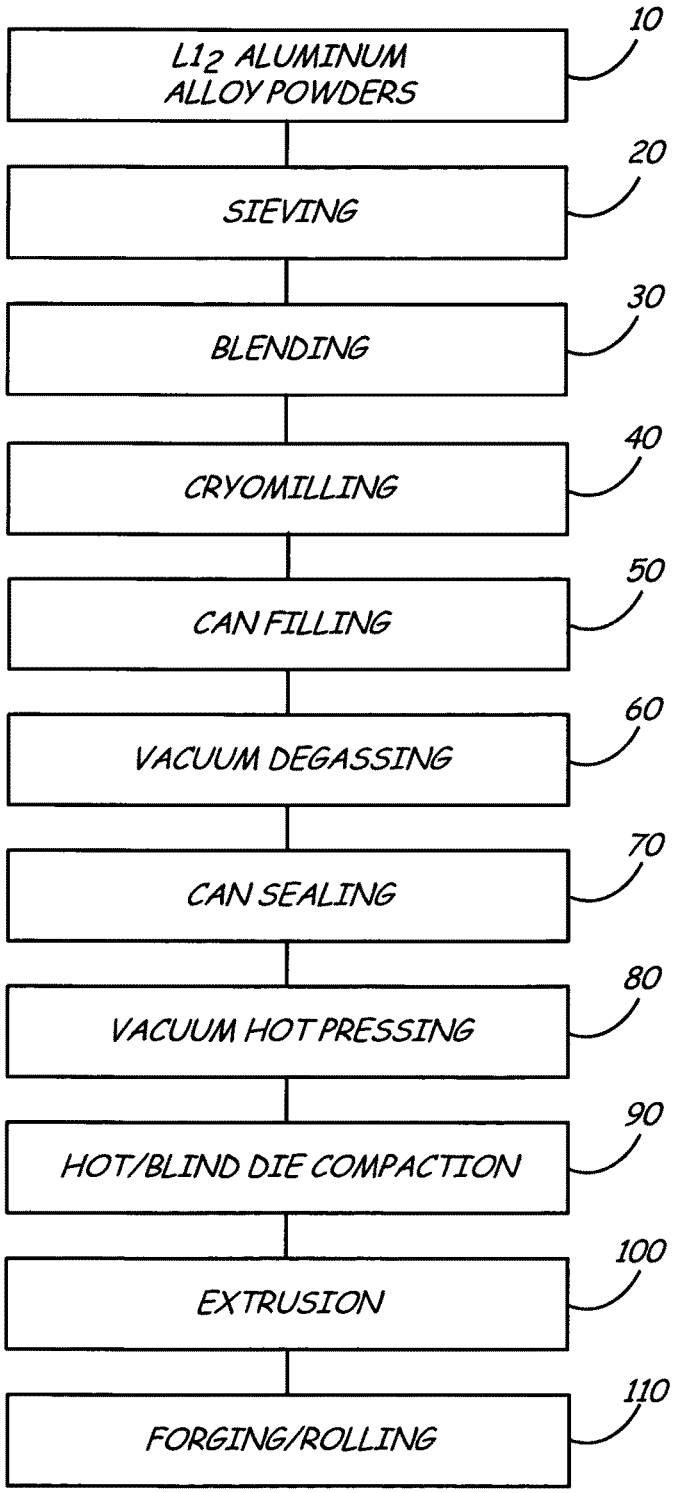
FIG. 10 is a schematic diagram of the consolidation process.

The process of consolidating the inventive alloy powders into useful forms is schematically illustrated in FIG. 10. $L1_2$ aluminum alloy powders (step 10) are first classified according to size by sieving (step 20). Fine particle sizes are required for optimum mechanical properties in the final part. Next, the classified powders are blended (step 30) in order to maintain microstructural homogeneity in the final part. Blending is necessary because different atomization batches produce powders with varying particle size distributions. The sieved and blended powders are then put in a can (step 50) and vacuum degassed (step 60). Following vacuum degassing (step 50) the can is sealed (step 70) under vacuum and hot pressed (step 80) to densify the powder compact.

Sieving (step 20) is a critical step in consolidation because the final mechanical properties relate directly to the particle size. Finer particle size results in finer $L1_2$ particle dispersion. Sufficient mechanical properties have been observed with 450 mesh (30 micron) powder. Sieving (step 20) also limits the defect size in the powder. Before sieving, the powder is passivated with nitrogen gas in order to minimize reaction of the powder with the atmosphere. The powder is stored in a nitrogen atmosphere to prevent oxidation. However, if the powder is completely clean and free from oxides, it sticks together reducing the efficiency of sieving. If the oxygen content in the powder is too high, it has a deleterious effect on the mechanical properties. There is an optimal oxygen level which is desired such that it does not create any sieving problem and yields good mechanical properties. The oxygen content of the powder is between about 1 ppm and 2000 ppm, preferred between about 10 ppm to 1000 ppm and most preferred between about 25 ppm to about 500 ppm. Ultrasonic sieving is preferred for its efficiency.

Blending (step 30) is a preferred step in the consolidation process because it results in improved uniformity of the particle size distribution. Gas atomized $L1_2$ aluminum alloy powder generally exhibits a bimodal particle size distribution and cross blending of separate powder batches tends to homogenize the particle size distribution. Blending (step 30) is also preferable when separate metal and/or ceramic powders are added to the $L1_2$ base powder to form bimodal or trimodal consolidated alloy microstructures.

Following sieving (step 20) and blending (step 30), the powders are transferred to a can (step 50) where the powder is vacuum degassed (step 60) at elevated temperatures. The can (step 50) is an aluminum container having a cylindrical, rectangular or other configuration with a central axis. Vacuum degassing times can range from about 0.5 hours to about 8 days, more preferably it can range from about 4 hours to 7 days, even more preferably it can range from about 8 hours to about 6 days. A temperature range of about 300° F. (149° C.) to about 900° F. (482° C.) is preferred and about 600° F. (316° C.) to about 850° F. (454° C.) is more preferred and 650° F. (343° C.) to about 850° F. (454° C.) is most preferred. Dynamic degassing of large amounts of powder is preferred to static degassing. In dynamic degassing, the can is preferably rotated during degassing to expose all of the powder to a uniform temperature. Degassing removes oxygen and hydrogen from the powder.

The role of dynamic degassing is to remove oxygen and hydrogen more efficiently than that of static degassing. Dynamic degassing is very important for large billets to reduce the time and temperature required for degassing. Static degassing works well for small sizes of billets and small quantities of powder as it does not take long to degas effectively. For large billets, it can take several days to degas at high temperatures which can coarsen the material microstructure and reduce the strength. In addition, the process efficiency goes down with longer degassing times.

Following vacuum degassing (step 60), the vacuum line is crimped and welded shut (step 70). The powder is then consolidated further by unaxially hot pressing (step 80) the evacuated can in a die or by hot isostatic pressing (HIP) (step 80) the can in an isostatic press. The billet can be compressed by blind die compaction (step 90). At this point the powder charge is nearly 100 percent dense and the can may be removed by machining.

Figure 11:
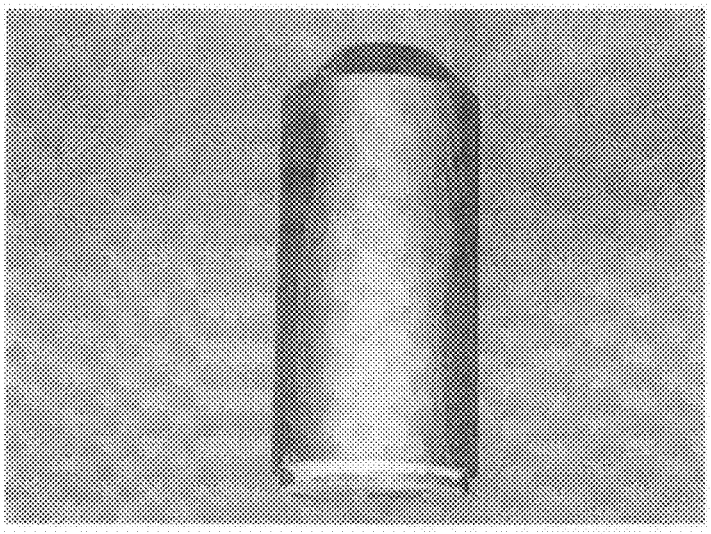
FIG. 11 is a photo of an aluminum alloy billet.
Figure 12:
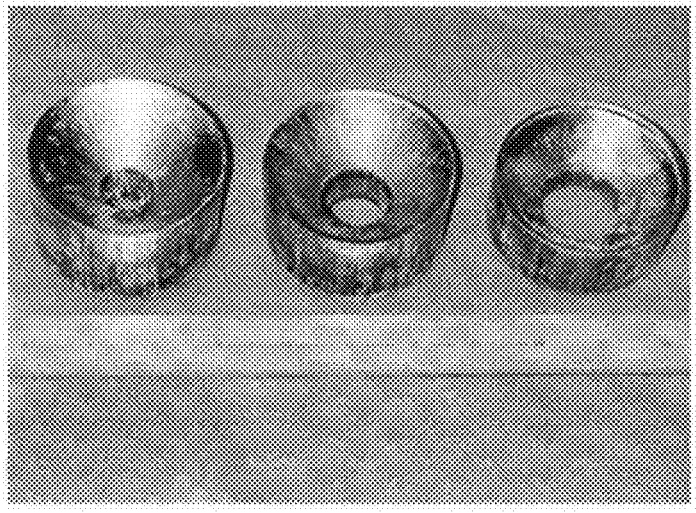
FIG. 12 is a photo of extrusion dies.
Figure 13:
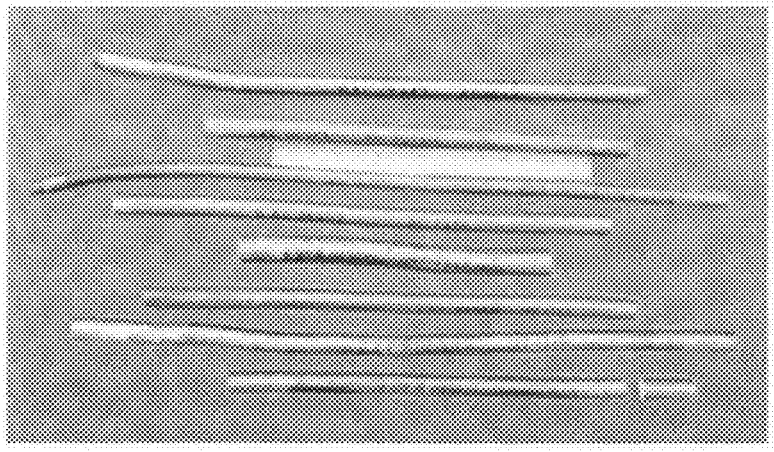
FIG. 13 is a photo of extrusions.

Following consolidation by powder metallurgy processing or casting, $L1_2$ aluminum alloy billets are deformation processed to refine microstructure, improve mechanical properties, and form into useful shapes. Deformation processing can be carried out by extrusion, forging, or rolling. FIG. 11 shows a 3-inch diameter, copper jacketed $L1_2$ aluminum alloy billet prepared from powder precursors ready for extrusion. FIG. 12 is a photo of 3-inch diameter extrusion dies. Representative extrusions are shown in FIG. 13. A 12-inch ruler is included in the photo for comparison.

Preferred heat treatments are homogenization anneals at about 900° F. (482° C.) to about 1000° F. (538° C.) for about 8 hours to about 24 hours. The alloys are then heat treated at a temperature of from about 800° F. (426° C.) to about 1,100° F. (593° C.) for between about 30 minutes and four hours, followed by quenching in water, and thereafter aged at a temperature from about 200° F. (93° C.) to about 600° F. (260° C.) for about two to about forty-eight hours.

Representative mechanical properties of extruded aluminum alloy billets are listed in Table 3.

TABLE 3

Tensile properties of extruded aluminum alloys

| Billet # | Ultimate Tensile Strength, ksi | Yield Strength, ksi | Elongation, % | Reduction in Area, % |
|---|---|---|---|---|
| 1 | 115.4 (795.7 MPa) | 102.4 (706.0 MPa) | 4 | 4.3 |
| 2 | 113.2 (780.5 MPa) | 100.8 (695.0 MPa) | 4 | 13 |
| 3 | 115.4 (795.7 MPa) | 104.2 (718.4 MPa) | 3.7 | 8.5 |
| 4 | 113.5 (782.6 MPa) | 101.9 (702.6 MPa) | 5.4 | 7.9 |
| 5 | 110.0 (758.4 MPa) | 101.3 (698.4 MPa) | 4.7 | 15 |
| 6 | 101.2 (697.8 MPa) | 93.2 (642.6 MPa) | 10.3 | 18 |
| 7 | 107.8 (743.2 MPa) | 96.1 (662.6 MPa) | 6.6 | 17.5 |
| 8 | 115.9 (799.1 MPa) | 101.7 (701.2 MPa) | 5 | 8.5 |

Table 3 shows tensile properties of extrusions fabricated from powders degassed at different temperatures. In general, the yield strength and ultimate tensile strength of $L1_2$ based alloys are excellent. These strength values are much higher than the strengths of commercial aluminum alloys including 6061, 2124 and 7075 alloys. Tensile strengths over 100 ksi (690 MPa) for an $L1_2$ aluminum alloy are remarkable and the alloy can provide significant weight savings by replacing high strength aluminum alloys, titanium, nickel and steel alloys. In addition, the elongation and reduction in area values for this $L1_2$ alloy are also very good. The yield strength remains fairly constant at over 100 ksi (690 MPa) for degassing and vacuum hot pressing temperature ranges of 500° F.-650° F. (260° C.-343° C.). The yield strength decreased slightly for degassing and vacuum hot pressing temperatures in the range of 700° F. to 750° F. (371°-399° C.). The ductility measured by elongation and reduction in area, however, increased significantly with an increase in degassing temperature. Reduction in area has increased almost two times for material degassed in the temperature range of 700° F.-750° F. (371° C.-399° C.) compared to material that was degassed in the temperature range of 500° F.-650° F. (260° C.-343° C.). These results are expected based on strengthening models including the Orowan strengthening model and the Hall-Petch strengthening model. Vacuum degassing is more effective when the powder is degassed at higher temperatures as indicated by a lower hydrogen content in material degassed at higher temperatures. Lower hydrogen results in higher ductility of the material as measured by elongation and reduction in area. However, strength is expected to decrease with an increase in degassing temperature because strengthening precipitates would start coarsening with an increase in degassing temperature, which is consistent with observed results from material degassed at 700° F. and 750° F. (371° C.-299° C.). These results indicate that properties of the $L1_2$ alloy can be varied by controlling the degassing and vacuum hot pressing temperature. In order to have a balanced combination of strength and ductility in the material, the $L1_2$ alloy needs to be degassed and vacuum hot pressed at specific temperatures and times. The results obtained here demonstrate success of the present invention.

Although the present invention has been described with reference to preferred embodiments, workers skilled in the art will recognize that changes may be made in form and detail without departing from the spirit and scope of the invention.

The invention claimed is:

1. A method for forming a heat treatable high strength aluminum alloy containing $L1_2$ dispersoids, comprising the steps of:

preparing an aluminum alloy composition consisting of:

at least one first element selected from the group consisting of about 0.1 to about 6.0 weight percent erbium, about 0.1 to about 10.0 weight percent thulium, about 0.1 to about 15.0 weight percent ytterbium, and about 0.1 to about 12.0 weight percent lutetium;

at least one second element selected from the group consisting of about 0.1 to about 4.0 weight percent gadolinium, about 0.1 to about 4.0 weight percent yttrium, about 0.05 to about 2.0 weight percent titanium, and about 0.05 to about 1.0 weight percent niobium to the aluminum alloy;

at least one third element selected from the group consisting of about 4 to about 18 weight percent silicon, about 1 to about 2 weight percent lithium, and about 3.5 to about 6.5 weight percent copper; and the balance substantially aluminum;

melting the composition to form an alloy;

casting the alloy to form a solid product; and heat treating the alloy to form $L1_2$ dispersoids.

2. The method of claim 1, wherein the solid product is selected from the group comprising:

a usable part;

a billet for deformation processing; and a powder.

3. The method of claim 1, wherein casting comprises pouring the melted alloy into a mold.

4. The method of claim 1, wherein casting comprises rapid solidification with cooling rates greater than $10^{3\circ}$ C./second by gas atomization formation of aluminum alloy powder.

5. The method of claim 4, wherein the gas atomization process is an inert gas atomization process comprising:

inert gas consisting of at least one of argon, nitrogen and helium;

melt superheat temperature from about 100° F. (38° C.) to about 300° F. (149° C.);

gas pressure of about 50 psi (0.35 MPa) to about 750 psi (5.2 MPa);

metal flow rate of about from 0.5 pounds (0.23 kg) per minute to 25 pounds (11.3 kg) per minute; and gas pressure to metal weight ratio is about 100 psi/lb/min (1.52 MPa/kg/min) to about 1500 psi/lbs/min (22.8 MPa/kg/min).

6. The method of claim 5, wherein oxygen is introduced during atomization such that the oxygen content of the powder is between 1 ppm and 2000 ppm and the hydrogen content is about 1 ppm to about 1000 ppm.

7. The method of claim 1, wherein the heat treating comprises:

solution heat treatment at about 800° F. (426° C.) to about 1100° F. (593° C.) for about thirty minutes to four hours;

quenching; and aging at a temperature of about 200° F. (93° C.) to about 600° F. (315° C.) for about two to forty eight hours.

8. The method of claim 7, wherein heat treatment results in formation of $L1_2$ $Al_3X$ strengthening dispersoids to form in the aged alloy.

9. A method for producing a heat treatable high strength aluminum alloy billet containing $L1_2$ dispersoids, comprising the steps of:

(a) forming a melt consisting of:

at least one first element selected from the group comprising about 0.1 to about 4.0 weight percent erbium, about 0.1 to about 6.0 weight percent thulium, about 0.2 to about 8.0 weight percent ytterbium, and about 0.2 to about 8.0 weight percent lutetium;

at least one second element selected from the group comprising about 0.2 to about 2.0 weight percent gadolinium, about 0.2 to about 2.0 weight percent yttrium, about 0.1 to about 1.0 weight percent titanium, and about 0.1 to about 0.75 weight percent niobium;

at least one third element selected from the group consisting of about 4 to about 18 weight percent silicon, about 1 to about 2 weight percent lithium, and about 3.5 to about 6.5 weight percent copper; and the balance substantially aluminum;

(b) solidifying the melt to form a solid body; and (c) heat treating the solid body to form $L1_2$ dispersoids.

10. The method of claim 9, wherein the heat treating comprises:

solution heat treatment at about 800° F. (426° C.) to about 1100° F. (593° C.) for about thirty minutes to four hours;

quenching; and aging at a temperature of about 200° F. (93° C.) to about 600° F. (315° C.) for about two to forty eight hours.

11. The method of claim 9, wherein solidifying comprises rapid solidification process with cooling rates greater than about $10^{3\circ}$ C./second by gas atomization formation of aluminum alloy powder.

* * * * *